US005700157A

United States Patent [19]

Chung

[11] Patent Number: 5,700,157

[45] Date of Patent: Dec. 23, 1997

[54] ELECTRIC JACK WITH DISPLAY MEANS

[75] Inventor: Yu-Ping Chung, Hsinchu, Taiwan

[73] Assignee: D-Link Corporation, Hsinchu, Taiwan

[21] Appl. No.: 659,670

[22] Filed: Jun. 5, 1996

[51] Int. Cl.[6] ..... H01R 3/00

[52] U.S. Cl. ..... 439/490

[58] Field of Search ..... 439/488, 489, 439/490, 617, 619

[56] References Cited

U.S. PATENT DOCUMENTS 4,978,317 12/1990 Pocrass ..... 439/490
5,613,873 3/1997 Bell, Jr. ..... 439/490

*Primary Examiner*—Khiem Nguyen
*Assistant Examiner*—Yong Ki Kim
*Attorney, Agent, or Firm*—Jacobson, Price, Holman & Stern, PLLC

[57] ABSTRACT

An electric jack for the connection of an electric connector, including at least one plug hole disposed on a side wall of the jack for the installation of display means, sets of terminals respectively disposed in the at least plug hole at one end, each of the terminals having a receiving section, said receiving section having a clamp portion at one end and a mounting tail end at the other end extending out of the jack and adapted for connection to power source, and at least one display means for example LEDs respectively mounted in the at least one plug hole and detachably connected to the terminals, each of the at least one display means having a plurality of electrically conductive pins respectively plugged into the receiving section of the terminals in the respective plug hole, and a front side projecting out of the jack through which the display means can be conveniently removed out of the respective plug hole by a pliers or like tool for a replacement.

3 Claims, 4 Drawing Sheets

ELECTRIC JACK WITH DISPLAY MEANS

BACKGROUND OF THE INVENTION

The present invention relates to electric jacks for the connection of electric connectors, and relates more particularly to such an electric jack which has display means for example LEDs (light emitting diodes) detachably mounted in plug holes thereof and connected to respective terminals by plugging. The LEDs are replaceable when damaged.

FIG. 4 shows a prior art phone jack (6) with a LED (7). The LED (7) is mounted in the phone jack (6), having contact pins (71) extending out of the phone jack (6) for connecting to the circuit board. If the LED (7) is damaged after the installation of the phone jack (6) in the circuit board, the LED (7) with the phone jack (6) must be simultaneously replaced.

SUMMARY OF THE INVENTION

The present invention has been accomplished to provide an electric jack with display means which eliminates the aforesaid problem. According to the present invention, the electric jack comprises for example at least one jack hole, at least one plug hole disposed on a side wall of the jack hole, a set of terminals disposed in the plug hole, each of the terminals having a tubular receiving section, said receiving section having a clamp portion and a mounting tail end extending out of the jack and adapted for connection to the circuit board in which the electric jack is installed, and a display means for example a LED mounted in the plug hole and detachably connected to the terminals, the LED having a plurality of electrically conductive pins respectively plugged into the tubular receiving sections ends of the terminals, and a front side projecting out of the jack through which the LED can be conveniently removed out of the respective plug hole by a pliers or like tool for a replacement.

DETAILED DESCRIPTION OF THE PREFERRED EMBODIMENT

Figure 1:
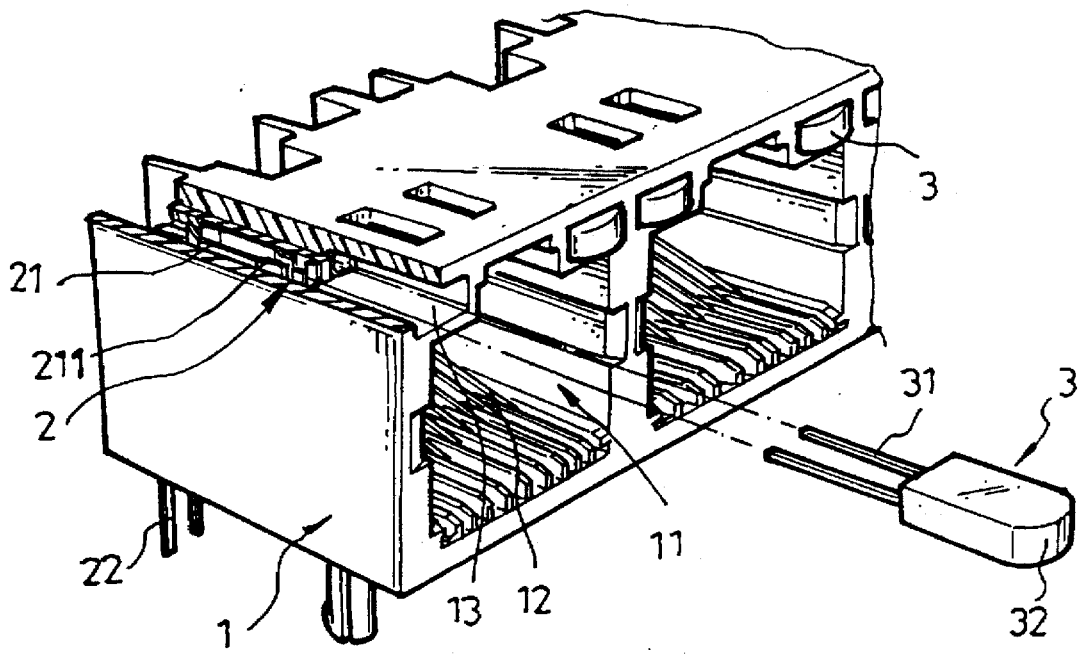
FIG. 1 is a cutaway view of an electric jack according to the present invention.
Figure 2:
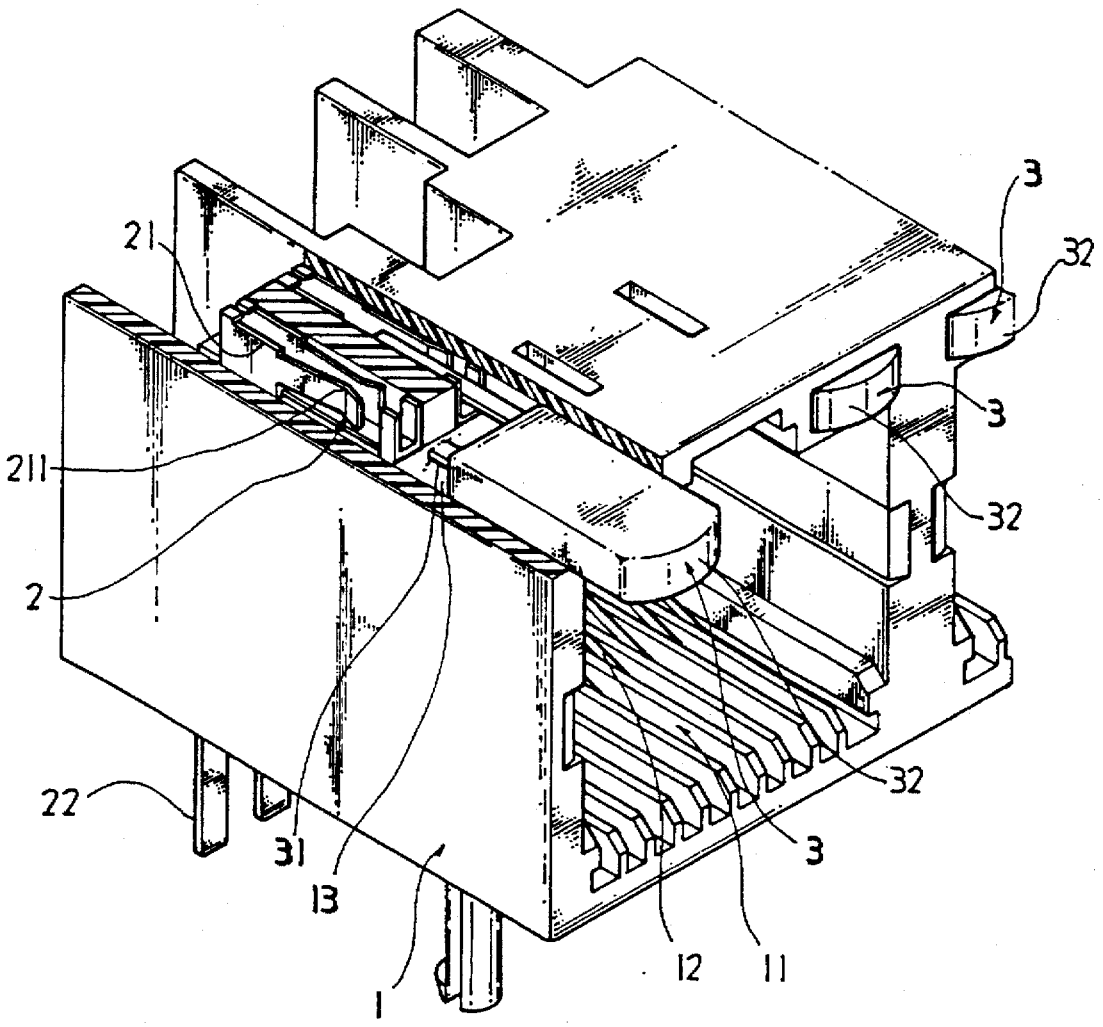
FIG. 2 is a cutaway view in an enlarged scale according to the present invention, showing one LED connected to the respective plug hole.
Figure 3:
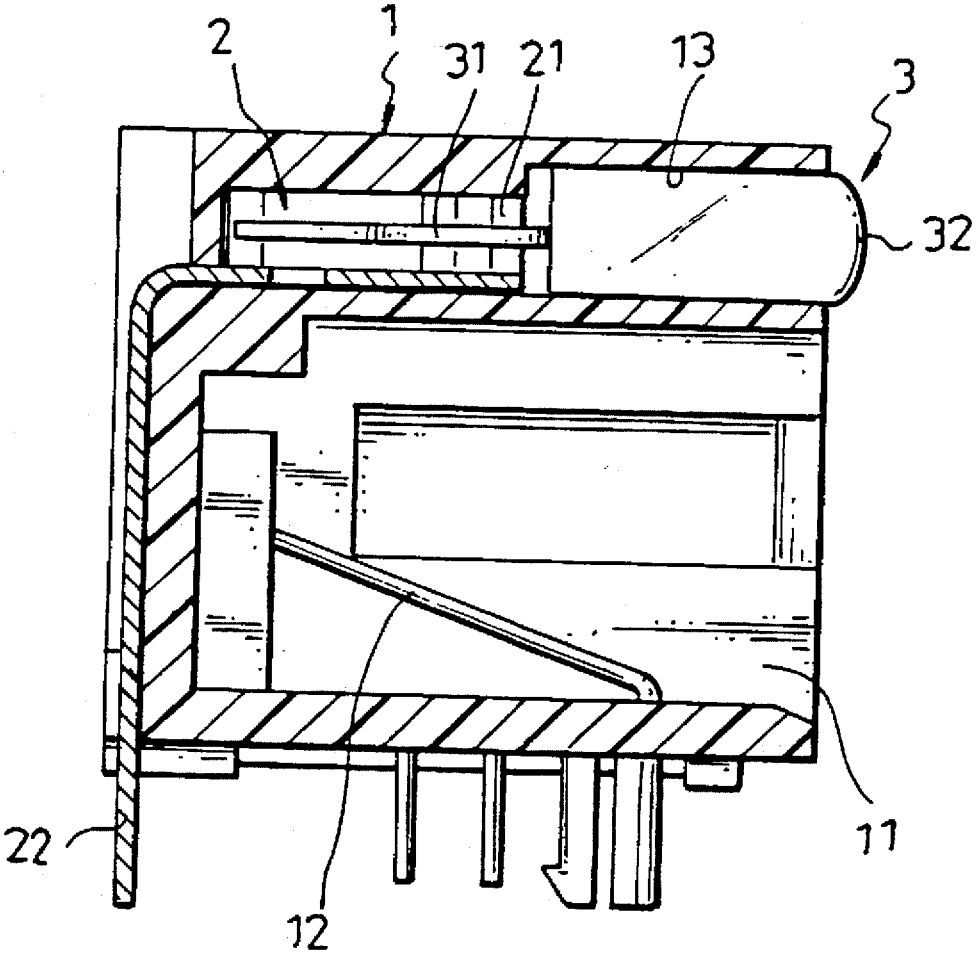
FIG. 3 is a sectional assembly view of FIG. 1.
Figure 4:
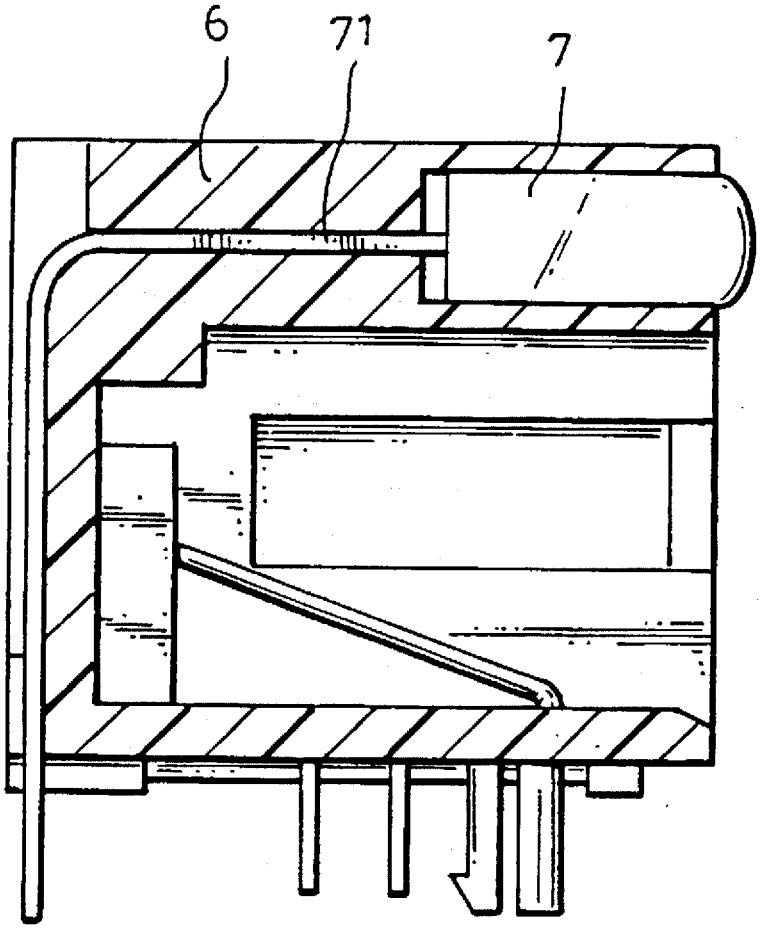
FIG. 4 prior art
FIG. 4 is a sectional view of a phone jack with a LED according to the prior art.

Referring to FIGS. 1 and 2, the electric jack, referenced by 1, comprises a jack hole 11 adapted for receiving a connector, a plurality of conductors 12 fixedly mounted inside the jack hole 11 at the bottom for the connection of the respective conductors of the connector installed, at least one plug hole 13 disposed on a side wall of the jack hole 11 at a suitable location, at least one display device for example LED (light emitting diode) 3 respectively installed in the at least one plug hole 13, and at least one set of terminals 2 for each pin 31 of a LED 3 respectively disposed adjacent to the at least one plug hole 13 ( in the preferred embodiment, there are two set of terminals disposed in one plug hole ). Each of the terminals 2 comprises a receiving section 21 with one end terminating in a clamp portion 211, and the other end a downward mounting tail end 22. The downward mounting tail end 22 of each of the terminals 2 extends out of the bottom side of the jack 1 for connecting to the circuit board.

Referring to FIG. 2, when one LED 3 is inserted into one plug hole 13, the pins 31 of the LED 3 are respectively inserted into the receiving sections 21 of the respective set of terminals 2 and retained in place by the respective clamp portions 211, and therefore the LED 3 is electrically connected to the respective set of terminals 2. When the LED 3 is installed, the front side 32 of the LED 3 protrudes over the front side of the jack 1. If the LED 3 is damaged, it can be removed from the respective plug hole 13 by a round-nose pliers or the like for a replacement. Therefore, it is not necessary to replace the whole assembly of the jack 1 when the LED 3 is damaged. Furthermore, because the front side 32 of the LED 3 protrudes over the front side of the jack 1, it imparts a portion for the clamping of the round-nose pliers or like tool.

It is to be understood that the drawings are designed for purposes of illustration only, and are not intended as a definition of the limits and scope of the invention disclosed.

What the invention claimed is:

1. An electric jack for the connection of an electric connector, comprising at least one plug hole disposed on a side wall of the jack for the installation of display means, a plurality of terminals respectively disposed in said at least one plug hole at one end, each of said terminals having a receiving section, said receiving section having a clamp portion at one end facing the respective plug hole and a mounting tail end extending out of the jack and adapted for connection to a circuit board, and at least one display means respectively mounted in said at least one plug hole and detachably connected to said terminals, each of said at least one display means having a plurality of electrically conductive pins respectively plugged into the receiving section of the terminals in the respective plug hole.

2. The electric jack of claim 1 wherein each of said at least one display means has a front displaying side projecting out of the jack.

3. The electric jack of claim 1 wherein each of said at least one display means is a light emitting diode.

* * * * *